US005395062A

United States Patent [19]

Von Gehlen et al.

[11] Patent Number: 5,395,062

[45] Date of Patent: Mar. 7, 1995

[54] APPARATUS FOR REMOVING FIBER TUFTS BY SUCTION FROM A BALE OPENER

[75] Inventors: Walter Von Gehlen, Mönchengladbach; Andreas Kranefeld, Erkelenz, both of Germany

[73] Assignee: Trützschler GmbH & Co. KG, Mönchengladbach, Germany

[21] Appl. No.: 92,484

[22] Filed: Jul. 16, 1993

[30] Foreign Application Priority Data

Jul. 16, 1992 [DE] Germany ..... 42 23 332.1

[51] Int. Cl.[6] ..... B02C 19/12

[52] U.S. Cl. ..... 241/101.7; 241/605; 19/80 R

[58] Field of Search ..... 241/101.2, 101.7, 605; 19/80 R, 82

[56] References Cited

U.S. PATENT DOCUMENTS

| | | | |
|---|---|---|---|
| 4,365,764 | 12/1982 | Marx | 241/101.7 |
| 4,544,106 | 10/1985 | Hackenbeck et al. | 241/101.7 |
| 4,750,240 | 6/1988 | Temburg | 19/80 R |
| 4,785,504 | 11/1988 | Leifeld et al. | 19/80 R |
| 5,072,490 | 12/1991 | Leifeld et al. | 19/80 R |

FOREIGN PATENT DOCUMENTS 3321802 2/1984 Germany .

*Primary Examiner*—John Husar

*Attorney, Agent, or Firm*—Spencer, Frank & Schneider

[57] ABSTRACT

A bale opener assembly includes a travelling apparatus detaching fiber tufts from surfaces of fiber bales supported along the travel path; and a fiber tuft removing apparatus for removing the fiber tufts from the travelling apparatus by suction. The fiber tuft removing apparatus has a stationary suction channel extending along the travel path and having a longitudinal aperture oriented generally parallel to the travel path; a flexible cover belt stationarily covering major length portions of the longitudinal aperture; a guide mechanism mounted on the travelling apparatus for deflecting the cover belt away from and then back onto the longitudinal aperture, whereby in the suction channel a fiber tuft intake opening is provided which co-travels with the travelling apparatus and through which fiber tufts are introduced into the suction channel from the travelling apparatus during operation. The longitudinal aperture is provided laterally along the suction channel and the cover belt is, along the longitudinal aperture, oriented at an angle to the horizontal other than zero.

27 Claims, 4 Drawing Sheets

APPARATUS FOR REMOVING FIBER TUFTS BY SUCTION FROM A BALE OPENER

CROSS REFERENCE TO RELATED APPLICATION

This application claims the priority of German Application No. P 42 23 332.1 filed Jul. 16, 1992, which is incorporated herein by reference.

BACKGROUND OF THE INVENTION

This invention relates to an apparatus for removing fiber tufts from a travelling bale opener by suction. The apparatus includes a stationary suction channel which has a continuous, stationary aperture along its length. A cover belt lies over the longitudinal channel aperture for closing the same substantially airtight along most of its length. Guide elements lift the cover belt off the suction channel along a short length portion thereof to expose, within the confines of the travelling bale opener, a fiber tuft intake opening which is part of the stationary aperture of the channel. Thus, along the travelling path of the bale opener the stationary suction channel is covered at the top by the belt except for the travelling fiber tuft intake opening.

In a known apparatus of the above-outlined type the guide elements comprise three rotary rollers. Two rollers are situated immediately at the channel and one roller is at a distance therefrom. The cover belt is guided away from the channel to define one end of the fiber tuft intake opening and is guided over the opening parallel to the travelling direction of the fiber bale opener and is thereafter guided downwardly onto the channel to thus define the other end of the fiber tuft intake opening. In this arrangement the belt is, in front and after the lift-off position, situated underneath the two rollers that are located immediately adjacent the channel and, at the location above the lift-off position, the belt is situated above the third, remote roller. Thus, the travelling fiber tuft intake opening is situated at the top of the channel and the plane in which the major surface of the belt lies is horizontal. A fiber tuft inlet nipple merges into the channel underneath the lifted cover belt; for this purpose the inlet nipple must be bent twice about an angle of 90°.

The above-outlined conventional apparatus has several further disadvantages: the structural height is necessarily very large and the entire suction device must be installed next to the bale opener which requires substantial additional space. Further, the third roller which is supported at a distance from the stationary suction channel is structurally complex and is difficult to install. Such third roller must be very accurately axially parallel to the two other rollers to prevent the cover belt from slipping off laterally. The third roller is an additional rotary structural element which may be soiled in operation by dust and fiber fly. Further, the size of the travelling fiber tuft inlet opening for introducing the inlet nipple has to be limited in size. Also, the suction stream that carries the fiber tufts has to be deflected twice which is structurally and flow-dynamically disadvantageous.

SUMMARY OF THE INVENTION

It is an object of the invention to provide an improved apparatus of the above-outlined type from which the discussed disadvantages are eliminated and which, in particular, is structurally simple, needs little space and makes possible an improved flow of the fiber tuft-carrying suction stream.

This object and others to become apparent as the specification progresses, are accomplished by the invention, according to which, briefly stated, the bale opener assembly includes a travelling apparatus detaching fiber tufts from surfaces of fiber bales supported along the travel path; and a fiber tuft removing apparatus for removing the fiber tufts from the travelling apparatus by suction. The fiber tuft removing apparatus has a stationary suction channel extending along the travel path and having a longitudinal aperture oriented generally parallel to the travel path; a flexible cover belt stationarily covering major length portions of the longitudinal aperture; a guide mechanism mounted on the travelling apparatus for deflecting the cover belt away from and then back onto the longitudinal aperture, whereby in the suction channel a fiber tuft intake opening is provided which co-travels with the travelling apparatus and through which fiber tufts are introduced into the suction channel from the travelling apparatus during operation. The longitudinal aperture is provided laterally along the suction channel and the cover belt is, along the longitudinal aperture, oriented at an angle to the horizontal other than zero.

By arranging the longitudinal channel aperture and the cover belt laterally relative to the channel, the structural height of the apparatus is reduced essentially to the height of the channel. It is a further advantage of the lateral arrangement that the fiber tuft suction stream is deflected only once which reduces the flow resistance and thus makes possible a significantly improved flow behavior of the pneumatically conveyed fiber tuft stream.

The invention has further additional features as follows:

- The cover belt guiding mechanism comprises a curved element having a fixed, non-rotary surface on which the cover belt glides. The curved element is structurally simple and permits a secure guidance of the belt without lateral wandering as the belt glides over the curved element.
- The curved element is so structured that it moves the cover belt away from the longitudinal aperture of the suction channel and then returns the cover belt into contact with a lateral channel wall.
- The curved element is formed of two parts which are advantageously symmetrical components, facilitating manufacture.
- The curved element has a convex outer surface contacting the cover belt.
- The convex surface of the curved element is smooth and has low-friction properties.
- The curved element may be made of wood whose convex upper surface is polished.
- The curved element may be of metal such as steel having a smooth upper surface.
- The convex surface of the curved element may be provided with a low-friction material such as a plastic.
- The curved element has a concave inner surface.
- The inlet nipple extends into the channel between the belt and the channel and merges into the channel in a horizontal orientation.
- The plane in which the principal surface of the cover belt lies is inclined to the vertical at an angle of between 0° and 15°.

The lower edge of the cover belt is countersupported by a supporting element mounted on the suction channel.

A further belt-supporting element is carried by the curved element.

The curved element carries at least one abutment element for the cover belt.

The cover belt is pre-tensioned at both ends.

On the cover belt and/or the channel magnetic elements are provided which cooperate with a magnetic counter surface.

The channel extends off center between the lateral parts of the undercarriage of the bale opener.

The fiber tuft inlet nipple is situated approximately in the middle of the lateral parts of the undercarriage.

That surface of the cover belt which cooperates with the convex surface of the curved element has low-friction properties.

DESCRIPTION OF THE PREFERRED EMBODIMENT

Figure 1A:
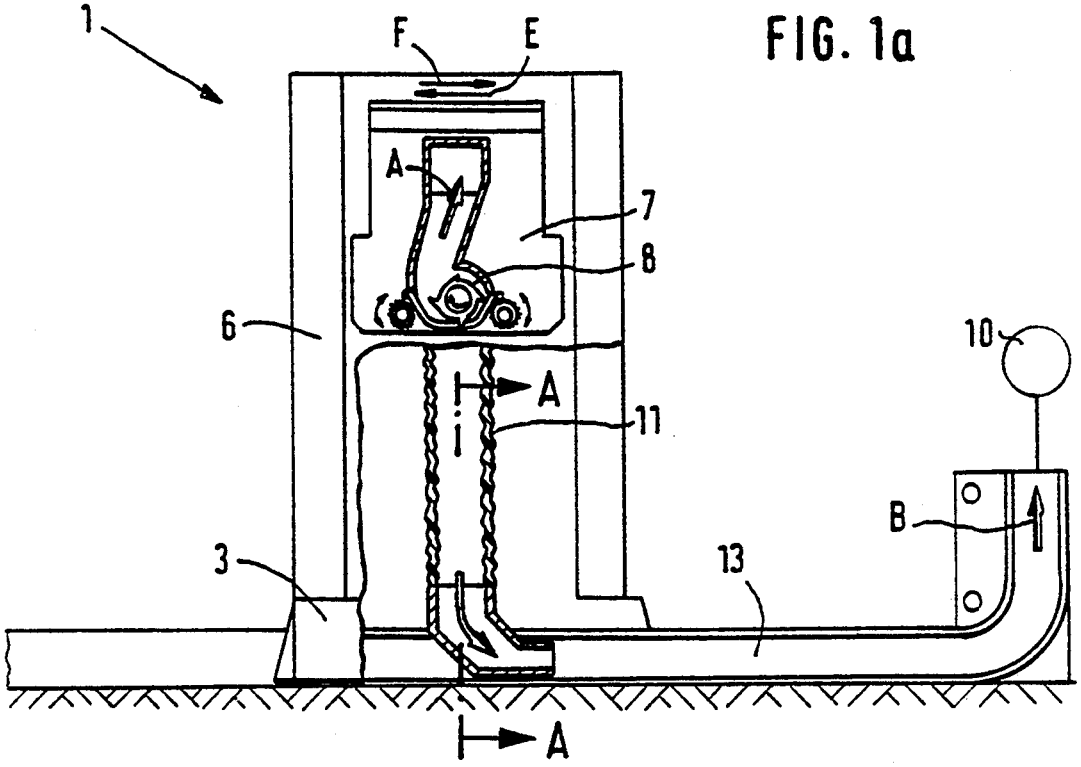
FIG. 1*a* is a schematic sectional side elevational view of a preferred embodiment of the invention.
Figure 1B:
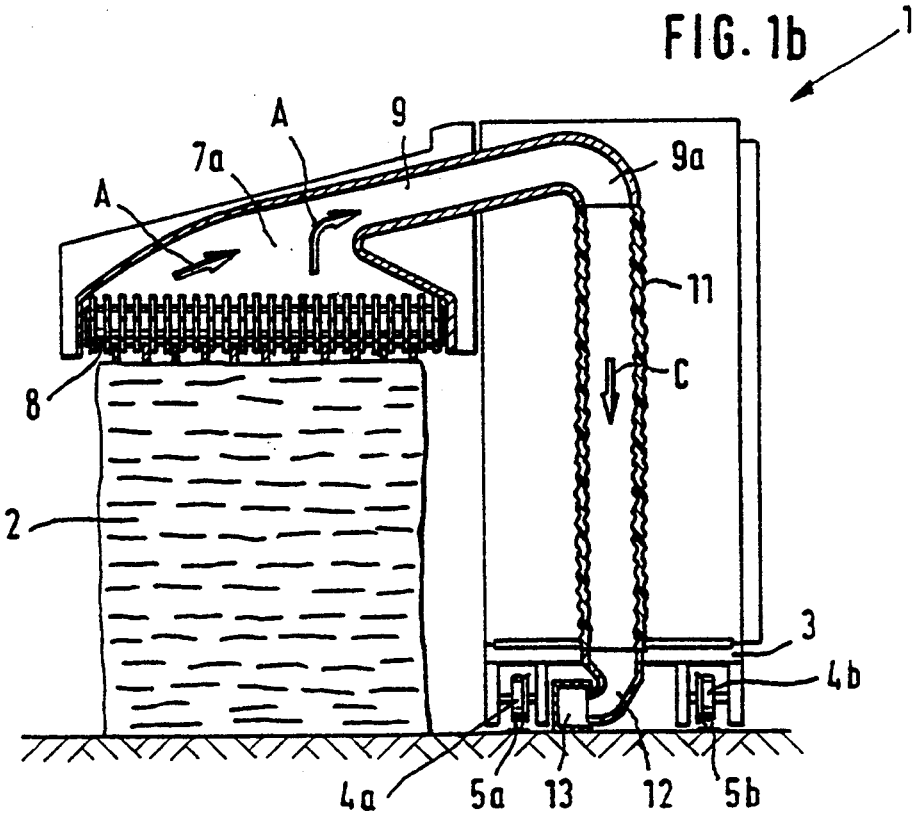
FIG. 1*b* is a schematic sectional front elevational view of the construction shown in FIG. 1*a*.

Turning to FIGS. 1*a* and 1*b*, there is illustrated therein a travelling bale opener generally designated at 1 which serves for detaching fiber tufts from the top of serially arranged fiber bales 2 as it is propelled along its travel path indicated by arrows E and F. The bale opener 1 has an undercarriage 3 provided with wheels 4*a*, 4*b* running of rails 5*a*, 5*b* along which the fiber bale series extends. The undercarriage 3 supports a bale opener tower 6 on which there is mounted a downwardly open cantilever housing 7 accommodating a rapidly rotating opening (fiber tuft detaching) roll 8.

As the bale opener 1 travels, the opening roll 8 detaches fiber tufts from the upper face of the fiber bales 2 and throws the detached fiber material into a chamber 7*a* formed in the housing 7 above the opening roll 8. From the chamber 7*a* and out of the bale opener 1 the fiber tufts are, in a manner to be described in more detail later, removed by means of a suction stream designated with A, B and C.

As the height of the fiber bales 2 decreases, the cantilever housing 7 is periodically lowered at the tower 6 to maintain the opening roll 8 in a working contact with the upper bale surface.

A travelling bale opener which comprises the above-described general principal components is known and may be a BLENDOMAT BDT 013 model bale opener manufactured by Trützschler GmbH & Co. KG, Mönchengladbach, Germany.

The chamber 7*a* of the cantilever housing 7 communicates with a duct 9 arranged in the tower 6. The duct 9 terminates in the upper portion of the tower 6 in a downwardly open elbow 9*a* coupled to a vertically extending, resiliently expanding and retracting accordion hose 11.

Figure 2A:
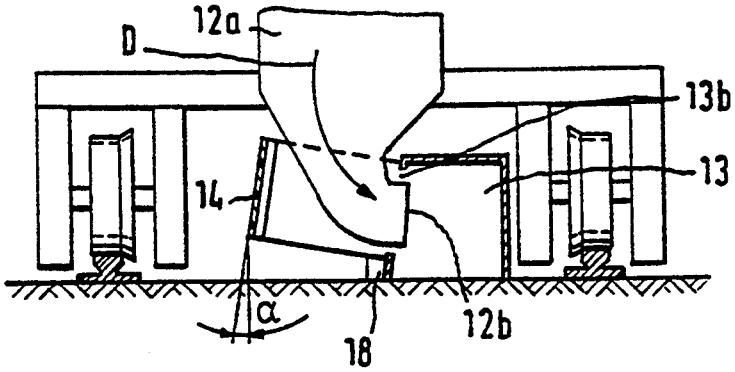
FIG. 2*a* is a schematic sectional front elevational view showing further details of a portion of the structure shown in FIG. 1*b*.

The accordion hose 11 continues, at its downstream end, in a funnel-shaped fiber tuft inlet nipple 12. For this purpose, as seen in FIGS. 2*a* and 4*b*, the lower, cross-sectionally circular terminus 22 of the hose 11 is coupled to the cross-sectionally rectangular inlet end 12*a* of the nipple 12 which has an outlet end 12*b*.

Underneath the undercarriage 3 of the bale opener 1 there is disposed a stationary, ground-supported suction channel-13 situated off center between the two rails 5*a* and 5*b* along the entire length of the travel path of the bale opener 1. The channel 13 is cross-sectionally rectangular and has, in one of its side walls, a continuous, longitudinal aperture 13*a*. The fiber tuft inlet nipple 12 communicates with the inside of the channel 13, in a manner to be described later, to introduce the fiber tufts into the channel 13 (as indicated by arrow D), carried by the suction stream generated by a suction source 10 coupled, for example, to one end of the suction channel 13. The suction source 10 may comprise, for example, a suction pipe coupled to the intake (low pressure) side of a non-illustrated blower.

Figure 2B:
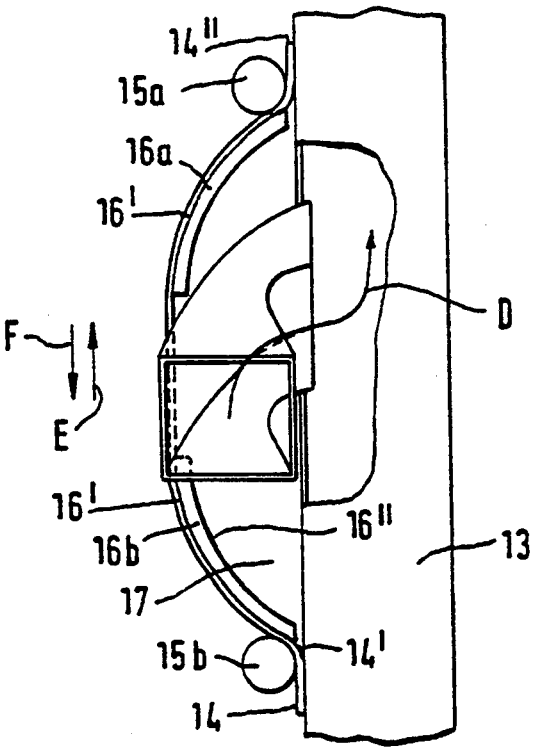
FIG. 2*b* is a top plan view of the construction shown in FIG. 2*a*.
Figure 2C:
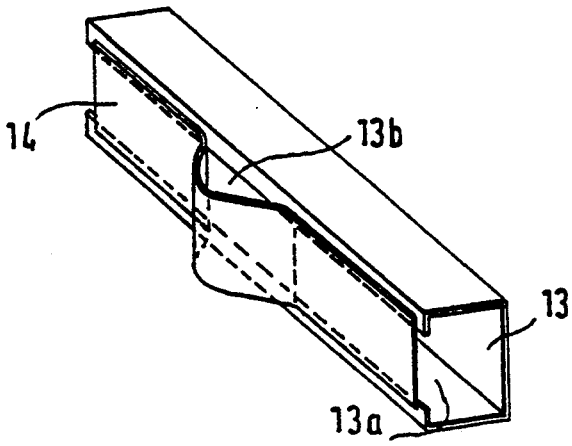
FIG. 2*c* is a schematic perspective view of a portion of the suction channel with cover belt.

A flexible stationary cover belt 14, fixedly held at opposite ends, lies externally on the channel side wall which contains the aperture 13*a* and thus covers, along a major length portion, the longitudinal aperture 13*a* as shown in FIG. 2*c*.

The cover belt 14 is, by means of guide elements carried by the bale opener 1, lifted off the channel 13, guided at a distance from the channel along its length and then returned to the channel into contact therewith. In this manner, as seen particularly in FIG. 2*c*, as part of the stationary longitudinal aperture 13*a* a travelling inlet opening 13*b* is provided through which the inlet nipple 12 may, by means of its outlet 12*b*, communicate with the inside of the channel 13. The travelling inlet opening 13*b* is thus of such a dimension that it properly accommodates the inlet nipple 12.

Referring to FIGS. 2*a*, 2*b* and 4*b*, the guide elements which co-travel with the bale opener 1 to lift the cover belt 14 off the channel 13 to define the travelling opening 13*b*, include two rotary deflecting rollers 15*a*, 15*b* situated immediately adjacent the channel 13 and two curved elements 16*a*, 16*b* situated between the rollers 15*a*, 15*b*. When the bale opener 1 travels in direction F, the rollers 15*a*, 15*b* rotate counterclockwise (FIG. 4*b*, arrows K and H) and when the bale opener 1 travels in direction E, the rollers 15*a*, 15*b* rotate clockwise (FIG. 4*b*, arrows I and G). Such a rotation is generated as the rollers 15*a*, 15*b* co-travel with the bale opener 1 and frictionally engage the cover belt 14. The side wall of the channel 13 in which the longitudinal aperture 13*a* is provided, the cover belt 14, the respective rotary axes 15*a*' and 15*b*' of the rolls 15*c* and 15*b* as well as the guide elements 16*a* and 16*b* may be obliquely oriented as it may be observed in FIGS. 2*a*, 3 and 4*a*. Such orientation, however, may also be vertical. Thus, generally, the angle of inclination $\alpha$ (FIG. 2*a*) of these components relative to the vertical may be between 0 and approximately 15°. A typical value for the angle $\alpha$ may be 10°.

During operation the cover belt 14 glides over the curved, non-rotary elements 16*a*, 16*b* while the bale opener travels in the direction of the arrow E or F. The curved elements 16*a*, 16*b* are situated between the cover belt 14 and the channel 13. The two curved elements 16*a*, 16*b* which are arranged symmetrically relative to one another and which may be, for example, of wood, have a convex outer face 16' which contacts the belt 14. The convex face 16' of the guide elements 16*a*, 16*b* is smooth, wear-resistant and has low-friction properties. Further, the curved elements 16*a*, 16*b* have concave inner faces 16" which define a chamber 17 for accommodating the travelling inlet nipple 12. The upper, inlet portion 12*a* of the funnel-shaped inlet nipple 12 extends from above between the off-standing cover belt 14 and the channel 13 into the space 17 and merges, after a deflection to form the outlet part 12*b*, approximately horizontally through the opening 13*b* into the channel 13.

Figure 3:
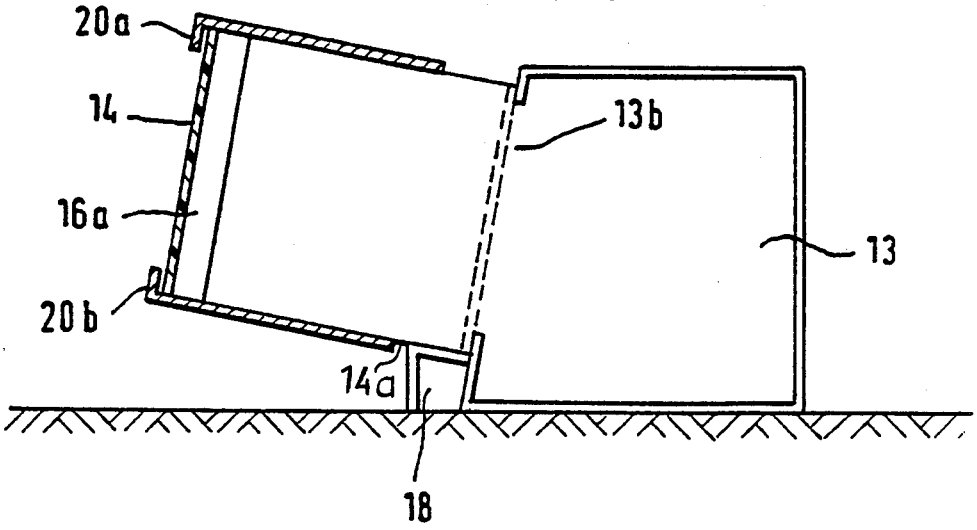
FIG. 3 is a sectional front elevational view of a suction channel with an oblique positioning of the cover belt.
Figure 4A:
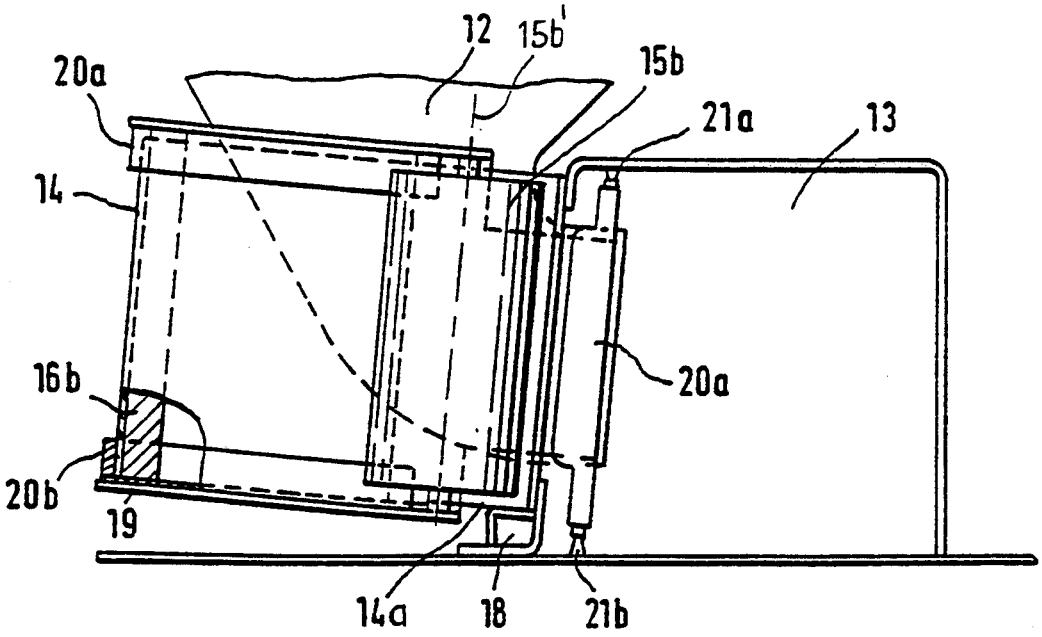
FIG. 4*a* is a sectional front elevational view of the suction channel with travelling and stationary supporting elements for the cover belt and a sealing element.
Figure 4B:
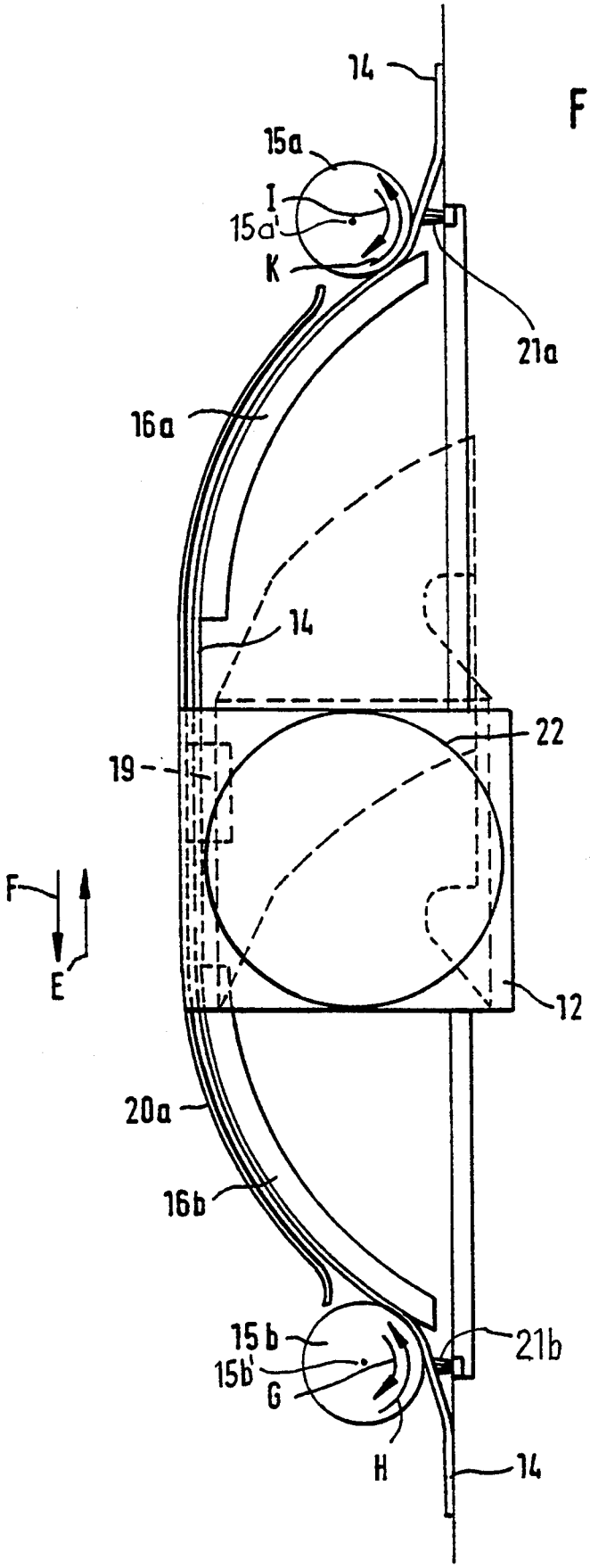
FIG. 4*b* is a sectional top plan view of the construction shown in FIG. 4*a*, illustrating deflecting rollers, a two-part curved element as well as a portion of the cover belt.

Referring in particular to FIGS. 3, 4*a* and 4*b*, the lower edge 14*a* of the cover belt 14 lies on a stationary supporting element 18 which is mounted on the channel 13. Further, the curved elements 16*a*, 16*b* carry a travelling supporting element 19 (as shown in FIGS. 4 and 5) and a travelling abutment element 20*a*, 20*b*. In this manner a groove-like guide for the cover belt 14 is formed. The cover belt 14 is at both ends fixedly secured—in a manner not shown—under tension which, dependent upon the magnitude of the angle $\alpha$ may be different in order to ensure a secure contacting with the side wall of the channel 13, the guide rollers 15*a*, 15*b* and the curved elements 16*a*, 16*b*. The vacuum stream generated by the suction source 10 pulls the cover belt 14 against the side of the channel 13 to thus hermetically cover the aperture 13*a*.

During the working passes of the bale opener 1 in the direction of the arrows E and F, the vacuum stream generated by the suction source 10 draws the detached fiber tufts from the chamber 7*a* of the housing 7, the duct 9, the accordion hose 11, the inlet nipple 12 and the channel 13 in the direction of the arrow B to a location of further processing.

Referring in particular to FIG. 2*b*, the inner surface 14' of the cover belt 14 cooperating with the convex surface 16' of the curved elements 16*a*, 16*b* has low-friction properties. The cover belt 14 is made, for example, of a strong woven textile fabric which has on its outer surface 14" a PVC-layer and its inner surface 14' is a woven polyester fabric which is impregnated with polyurethane to increase its wear resistance and augment its sliding properties.

The outer surface 14" of the cover belt 14 rolls off the deflecting rollers 15*a*, 15*b* under pressure. Similarly, the inner surface 14' of the cover belt 14 lies under pressure against and slides on the curved elements 16*a*, 16*b*, while it stationarily engages the channel 13.

As seen in FIGS. 4*a* and 4*b*, between the fiber tuft intake opening 13*b* of the channel 13 and the outer face of the inlet nipple 12 two sealing plates 20*a*, 20*b* and two sealing brushes 21*a*, 21*b* are provided. This arrangement prevents undesired disturbing air streams from being drawn by the suction source 10 into the channel 13 through the opening 13*b*.

It will be understood that the above description of the present invention is susceptible to various modifications, changes and adaptations, and the same are intended to be comprehended within the meaning and range of equivalents of the appended claims.

What is claimed is:

1. In a bale opener assembly, including a travelling apparatus travelling back and forth along a travel path in a travel direction and detaching, during travel, fiber tufts from surfaces of fiber bales supported along the travel path;

a fiber tuft removing apparatus for removing the fiber tufts from the travelling apparatus by suction; the fiber tuft removing apparatus having a stationary suction channel extending along the travel path; the suction channel having a longitudinal aperture oriented generally parallel to the travel path;

a flexible cover belt extending stationarily in contact with the suction channel for covering at all times major length portions of the longitudinal aperture;

guide means mounted on the travelling apparatus for deflecting the cover belt away from the longitudinal aperture, for guiding the cover belt through a predetermined distance along the suction channel spaced therefrom and for returning the cover belt onto the suction channel, whereby in the suction channel a fiber tuft intake opening is provided which co-travels with said travelling apparatus and through which fiber tufts are introduced into the suction channel from the travelling apparatus during operation thereof; and means for generating and maintaining a suction stream in said suction channel;

the improvement wherein said longitudinal aperture is provided laterally along said suction channel and said cover belt is, along said longitudinal aperture, oriented at an angle to the horizontal other than zero.

2. The bale opener assembly as defined in claim 1, wherein said angle is 90°.

3. The bale opener assembly as defined in claim 1, wherein said cover belt is inclined at an angle of between 0° and approximately 15° to the vertical.

4. The bale opener assembly as defined in claim 1, wherein said cover belt has opposite ends; further comprising means for clamping said opposite ends with a pre-tension.

5. The bale opener assembly as defined in claim 1, further comprising magnet means for generating a magnetic attracting force between said cover belt and said suction channel.

6. The bale opener assembly as defined in claim 1, further comprising a stationary supporting element; said cover belt having a lower edge lying on said stationary supporting element.

7. The bale opener assembly as defined in claim 6, wherein said stationary supporting element is mounted on said suction channel.

8. The bale opener assembly as defined in claim 1, wherein said travelling apparatus has an undercarriage; said suction channel being disposed underneath said undercarriage.

9. The bale opener assembly as defined in claim 8, wherein said suction channel is disposed eccentrically relative to a width dimension of said undercarriage; said width dimension being measured horizontally, in a direction perpendicular to said travel direction.

10. The bale opener assembly as defined in claim 1, wherein said guide means comprises a curved guide element having an outer face; said cover belt engaging said outer face.

11. The bale opener assembly as defined in claim 10, wherein said curved guide element has a concave inner face.

12. The bale opener assembly as defined in claim 10, wherein said curved guide element is situated between said cover belt and said suction channel.

13. The bale opener assembly as defined in claim 10, wherein said curved guide element is a two-part component.

14. The bale opener assembly as defined in claim 10, wherein said outer face is convex and said cover belt is in a face-to-face engagement with the convex outer face.

15. The bale opener assembly as defined in claim 14, wherein said convex outer face is smooth and has low-friction properties.

16. The bale opener assembly as defined in claim 10, wherein said guide means further comprises first and second guide rollers each having an axis of rotation; said curved guide element being disposed between said first and second guide rollers; said cover belt being deflected by said first guide roller away from said suction channel and by said second guide roller toward said suction channel.

17. The bale opener assembly as defined in claim 16, wherein said outer face of said curved guide element and the rotary axes of said first and second guide rollers are at an angle other than zero to the horizontal.

18. The bale opener assembly as defined in claim 10, wherein said outer face of said curved guide element is non-rotary and said cover belt is arranged for gliding on and with respect to said curved guide element.

19. The bale opener assembly as defined in claim 18, wherein said cover belt has a cover belt face glidingly engaging said curved guide element; said cover belt face has low-friction properties.

20. The bale opener assembly as defined in claim 10, further comprising a supporting element mounted on said curved guide element to co-travel therewith; said cover belt having a lower edge slidingly supported on said supporting element.

21. The bale opener assembly as defined in claim 20, further comprising an abutment element mounted on said curved guide element to co-travel therewith; said abutment element extending over an edge zone of said cover belt; said cover belt being arranged between said abutment element and said curved guide element.

22. The bale opener assembly as defined in claim 21, wherein said supporting element and said abutment element together form a trough-like guide for said cover belt.

23. The bale opener assembly as defined in claim 1, wherein said fiber tuft removing apparatus further comprises a fiber tuft inlet nipple carried by said travelling apparatus; said fiber tuft inlet nipple extending from above into a space defined between said cover belt and said suction channel adjacent said fiber tuft intake opening of said suction channel.

24. The bale opener assembly as defined in claim 23, wherein said travelling apparatus has an undercarriage and further wherein said fiber tuft inlet nipple is positioned approximately medially of a width dimension of said undercarriage; said width dimension being measured horizontally, in a direction perpendicular to said travel direction.

25. The bale opener assembly as defined in claim 23, wherein said fiber tuft inlet nipple has a funnel-shaped configuration.

26. The bale opener assembly as defined in claim 23, wherein said fiber tuft inlet nipple extends approximately horizontally into said suction channel through said fiber tuft intake opening.

27. The bale opener assembly as defined in claim 23, further comprising a sealing means mounted on said travelling apparatus between said fiber tuft intake opening of said suction channel and an outer side of said fiber tuft inlet nipple for preventing ambient air from entering into said suction channel through said fiber tuft intake opening.

* * * * *